United States Patent [19]

Moser

[11] 4,196,817

[45] Apr. 8, 1980

[54] INSULATED PORTABLE BEVERAGE CONTAINER

[76] Inventor: D. Wescott Moser, Trollinger Professional Bldg., 200 Worth St., Asheboro, N.C. 27203

[21] Appl. No.: 961,974

[22] Filed: Nov. 20, 1978

[51] Int. Cl.[2] ..... B65D 31/02; B65D 23/08

[52] U.S. Cl. ..... 215/13 R; 62/372; 150/2.2; 222/105; 215/1 A

[58] Field of Search ..... 215/13 R, 11 C, 1 A; 150/2.2, 3, 2.1, 52 R, 52 F; 62/371, 372, 457; 222/105, 131, 183

[56] References Cited

U.S. PATENT DOCUMENTS

| | | | |
|---|---|---|---|
| 651,819 | 6/1900 | Bradshaw | 150/2.2 |
| 785,638 | 3/1905 | Scritchfield | 150/2.1 |
| 1,939,777 | 12/1933 | Humboldt | 215/13 R |
| 2,464,069 | 3/1949 | Benson | 150/52 F |
| 2,522,381 | 9/1950 | Kramer | 215/13 R |
| 2,575,191 | 11/1951 | Seipp | 150/2.1 |
| 2,661,785 | 12/1953 | Daust | 150/2.1 |
| 2,667,198 | 1/1954 | Klein | 150/2.1 |
| 3,344,977 | 10/1967 | Kamins | 150/3 |
| 3,799,914 | 3/1974 | Schmit | 215/1 A |
| 4,002,257 | 1/1977 | Hatridge | 215/13 A |

FOREIGN PATENT DOCUMENTS

| | | | |
|---|---|---|---|
| 196082 | 2/1958 | Fed. Rep. of Germany | 150/2.1 |
| 198908 | 8/1958 | Fed. Rep. of Germany | 150/2.1 |
| 1037486 | 9/1953 | France | 215/13 R |
| 1451642 | 9/1966 | France | 150/2.1 |
| 754637 | 8/1956 | United Kingdom | 150/2.1 |
| 1013331 | 12/1965 | United Kingdom | 215/13 R |

*Primary Examiner*—Donald F. Norton

[57] ABSTRACT

A beverage-containing squeeze bottle is removably contained within a soft, heat insulating outer jacket and has a flexible straw extending from within the bottle to a point exteriorly of the closed outer jacket. The outer jacket has a quickly releasable top opening, an outer covering, a waterproof innerlining, and an intermediate layer of insulating material therebetween. Ice is placed within the jacket surrounding the bottle. The soft outer jacket is then squeezed, forcing liquid out of the bottle through the straw.

2 Claims, 2 Drawing Figures

INSULATED PORTABLE BEVERAGE CONTAINER

BACKGROUND OF THE INVENTION

The continuing trend toward increased participation in sports such as tennis has created a growing market for equipment and accessories. A significant demand has developed for an insulated beverage container which may be used to chill beverages or to maintain a cold beverage and yet compact enough to be easily carried along with other equipment. There are many insulated beverage containers known in the prior art. The conventional thermos bottle is well known, but can only be used to maintain a temperature. A thermos bottle must be opened to pour beverages and each time it is opened some of the insulating effects are lost. Additionally, the innerlining of the bottle is frequently glass and will not withstand being dropped or knocked around.

Other insulated beverage containers which have spigots for the dispersal of liquids are frequently larger than desired for individual use and also necessitate the use of cups for drinking the beverage.

A further disadvantage to the devices of the prior art is that a beverage or liquid material must be brought to the desired temperature before being placed in the insulated container. If a soft drink or other beverage is purchased enroute to an event and is not prechilled there is little which can be done other than to add ice to the liquid. This addition of ice results in a usually undesirable dilution of the beverage.

SUMMARY OF THE PRESENT INVENTION

The present invention is directed to a portable, insulated beverage container of a type particularly adapted to individual use. The container may be used for maintaining the temperature of prechilled beverages, or ice may be contained therein, separately from the liquid, for chilling the liquid to a desirable level for drinking. A straw extends from within an inner liquid-containing bottle through the cap thereof to a point exterior of a thermal insulating outer jacket for ingesting liquid therethrough. Use of the straw permits the removal of beverage from within the container without significant change of thermal properties and without need for cups.

The structure of the beverage container includes an insulated outer envelope or jacket of a generally rectangular shape having an upper reclosable seam. The reclosable seam is located at the upper end and may be selectively opened or closed by means of a quick release device to receive the beverage containing bottle and ice therethrough. Closure of the seam is preferably by means of a textile fastening material commonly known as Velcro.

A squeeze bottle forms the actual beverage container and is preferably formed of a flexible material which will conduct heat. An elongated, flexible straw extends from within the bottle, through the cap thereof and outwardly through the seam of the container jacket. Use of the Velcro closure permits extension of the straw through any point of the seam and the Velcro will fasten tightly up to the walls of the straw thus preserving the insulating properties of the jacket.

The outer jacket or envelope consists of an exterior covering made of a decorative sheet material such as heavy canvas or duck or a lightweight plastic or vinyl. An inner lining inside the jacket is made of a moisture or liquid impervious sheet material, and an intermediate layer formed of an insulating material is positioned between the inner lining and the decorative exterior covering. The three pieces, exterior cover, inner lining and intermediate layer are joined together at the upper edge to function as a reclosable unit.

The unique concepts of the invention include the provision of a relatively small, insulated squeeze beverage container in which a beverage may be chilled and from which the beverage may be withdrawn and ingested without opening the outer jacket container or using cups.

Therefore, the objects of the invention include:

1. the provision of a portable, insulated beverage container designed primarily for use by an individual;

2. the provision of a portable, insulated beverage container from which a beverage may be withdrawn without the necessity of opening the container;

3. the provision of a beverage container as in objectives 1 and 2 and further including means for ingesting a beverage therefrom without use of cups or other secondary utensils; and 4. the provision of a portable, insulated beverage container having means to contain ice separately from the beverage for the purpose of chilling the beverage.

Other objects and advantages will become apparent to those skilled in the art as the following detailed description is studied in conjunction with the accompanying drawings of which:

FIG. 1 is a perspective view of a preferred embodiment of the present invention as it would appear in use; and FIG. 2 is a perspective view with parts broken away of the embodiment shown in FIG. 1 having the major components separated.

DETAILED DESCRIPTION OF A PREFERRED EMBODIMENT

Figure 1:
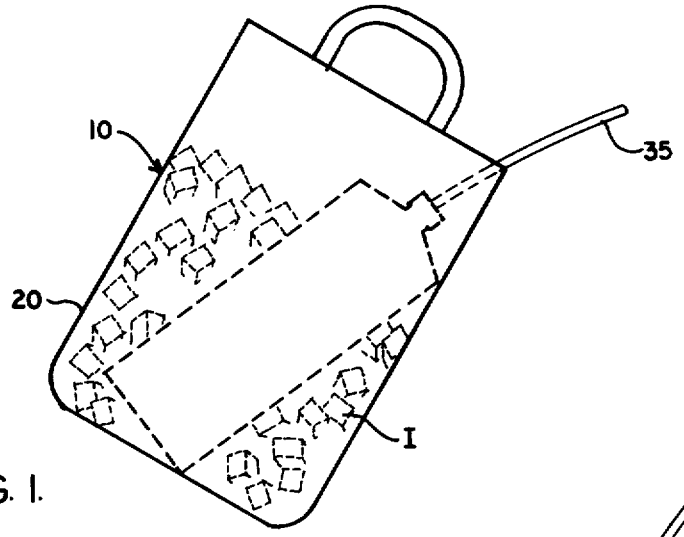
Figure 2:
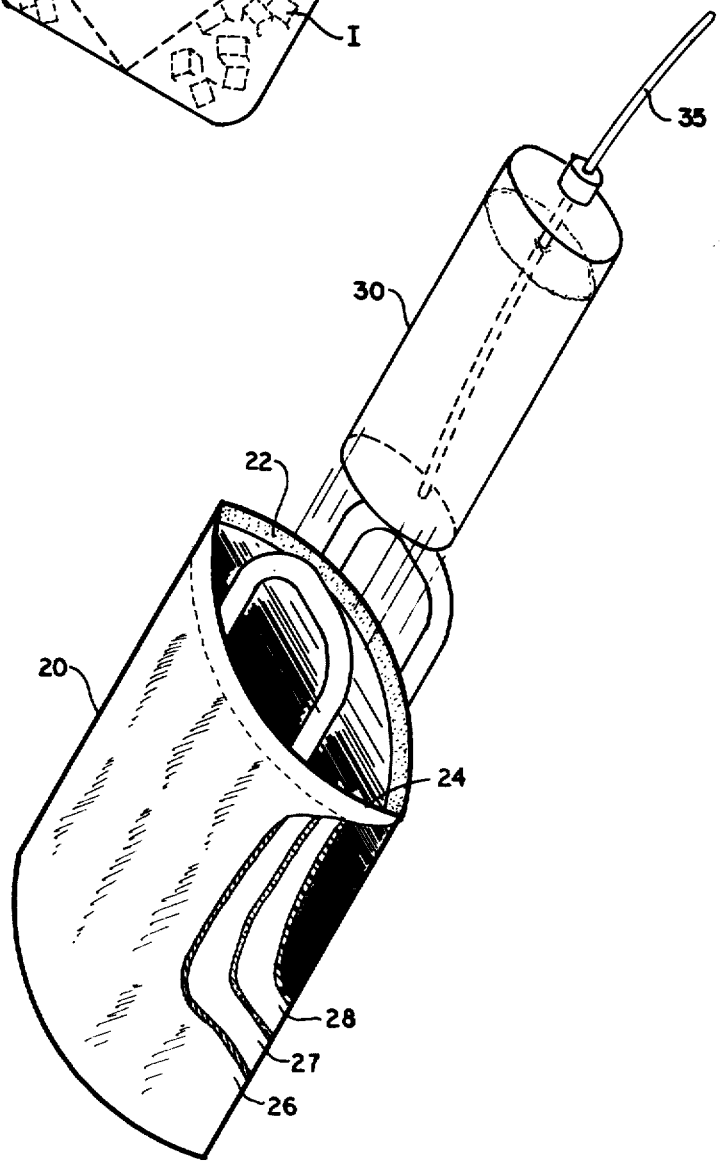

The beverage container according to a preferred embodiment of the present invention is shown in FIG. 1 at 10. The primary components of the container 10—the outer jacket 20 and the beverage bottle 30—are best illustrated individually in FIG. 2.

The portable container 10 includes the heat insulating outer jacket 20, handle(s) 21, the inner, beverage-holding squeeze bottle 30, and a flexible straw 35 extending from within the bottle 30 to a point exterior of the jacket. For a cold beverage, ice I is held within the jacket surrounding the bottle. The ice may be utilized to chill an uncooled beverage or to help maintain a prechilled beverage at the desired temperature.

The outer jacket 20 includes a reclosable edge or seam 22 which has a quick release closure means 24 for selectively opening and closing the jacket. The closure means 24 in the preferred embodiment comprises a contact engagable fabric fastener mounted along the opposite inner surfaces of the reclosable seam 22. The fastener is commonly known by the tradename Velcro and includes strips **24*a* and 24*b* of a textile material which is made up of minute interlocking loops on strip 24*a* and hooks on strip 24*b*. Other closures such as a zipper-like tongue and groove device, or a conventional zipper may be utilized. However, it is essential that the closure means 24 be formed of a device which will close tightly against the walls of the straw 35 enabling the straw to protrude while inhibiting the loss of the insulating properties of the jacket 20** as much as possible.

The jacket 20 is insulated to maintain cold beverages by means of an intermediate layer of insulation 27 which is sandwiched between the decorative outer sheet or cover 26 and a moisture or waterproof inner lining 28. Any known insulation material may be utilized for the intermediate layer 27 such as fiberglass batting, flexible foam products, or other equally efficient, known flexible insulators. One known insulator which is preferred is a DuPont material called "MICROFOAM". Although the reclosable seam 22 is not capable of being completely airtight, it is necessary that it be closed as tightly as possible with a minimal opening for the extension of the straw 35, thereby preventing excessive loss of thermal effects.

The squeeze bottle 30 is preferably formed of a flexible plastic material or other having good heat exchange capacity so that fluids contained therein may be chilled by the surrounding ice. Capacity of the bottle is optional so long as it may be completely enclosed within the outer jacket. The length of the conventional straw 35 is optional so long as it extends from substantially the bottom of bottle 30 through bottle cap 32 to a point exterior of the sealed jacket 20.

Although a specific embodiment is described in detail hereinabove, it should be recognized that various changes may be made without departing from the scope of the invention which is set forth in the claims hereinbelow.

What is claimed is:

1. An insulated beverage container including:

(a) an outer envelope having a reclosable seam along at least one edge thereof and a quick release closure means for selectively closing and opening said seam, said quick release closure means including selectively engageable strips of minute hooks and loops commonly known by the tradename Velcro;

(b) said outer envelope including a soft, flexible outer cover, an inner lining of moisture impervious, flexible sheet material and an intermediate layer of flexible insulation material positioned intermediately of said outer cover and said inner lining;

(c) a capped bottle removably contained within said outer envelope for holding a beverage therein, said bottle being formed of a flexible, heat conducting material; and (d) a flexible straw extending from within said bottle through said reclosable seam to a point exteriorly of said outer envelope, whereby a selected beverage may be placed in said bottle, chilled to or maintained at a desired temperature within said envelope, and by compressing or squeezing said flexible bottle the beverage may be forced through said straw as desired.

2. An insulated beverage container as in claim 1 further including handle means adjacent said reclosable seam.

* * * * *